US012366032B1

(12) United States Patent
Johnson et al.

(10) Patent No.: US 12,366,032 B1
(45) Date of Patent: Jul. 22, 2025

(54) WATER-BASED ANTI-PILLING FABRIC TREATMENT COMPOSITIONS

(71) Applicant: SCIESSENT LLC, Beverly, MA (US)

(72) Inventors: Kenneth Johnson, Swampscott, MA (US); Lester Franklin Stevens, Jr., Seal Beach, CA (US)

(73) Assignee: SCIESSENT LLC, Beverly, MA (US)

( * ) Notice: Subject to any disclaimer, the term of this patent is extended or adjusted under 35 U.S.C. 154(b) by 582 days.

(21) Appl. No.: 17/686,342

(22) Filed: Mar. 3, 2022

Related U.S. Application Data

(60) Provisional application No. 63/157,253, filed on Mar. 5, 2021.

(51) Int. Cl.

| | |
|---|---|
| ***D06M 15/643*** | (2006.01) |
| ***D06M 15/263*** | (2006.01) |
| ***D06M 15/564*** | (2006.01) |
| ***D06M 101/06*** | (2006.01) |
| ***D06M 101/26*** | (2006.01) |
| ***D06M 101/32*** | (2006.01) |

(52) U.S. Cl.
CPC ..... *D06M 15/643* (2013.01); *D06M 15/263* (2013.01); *D06M 15/564* (2013.01); *D06M 2101/06* (2013.01); *D06M 2101/26* (2013.01); *D06M 2101/32* (2013.01); *D06M 2200/35* (2013.01)

(58) Field of Classification Search
CPC ..... D06M 15/643; D06M 15/263; D06M 15/564; D06M 2101/06; D06M 2101/26; D06M 2101/32; D06M 2200/35
See application file for complete search history.

(56) References Cited

U.S. PATENT DOCUMENTS

| | | | | |
|---|---|---|---|---|
| 6,815,412 | B1 | 11/2004 | Kvita et al. | |
| 6,949,503 | B2 | 9/2005 | Kvita et al. | |
| 10,344,180 | B2 | 7/2019 | Koger et al. | |
| 2005/0039267 | A1 * | 2/2005 | Kvita ..... | C11D 3/124 8/115.51 |
| 2020/0002644 | A1 * | 1/2020 | Ghosh ..... | C11D 17/0047 |

OTHER PUBLICATIONS

ASTM International, Designation: D4970/D4970M, "Standard Test Method for Pilling Resistance and Other Related Surface Changes of Textile Fabrics: Martindale Tester", Jan. 2018.
Tennebroek, Ronald, et al., "Water-based Polyurethane Dispersions," Poly, Int. 2019, 68:832-842 DOI 10.1002/pi.5627.
www.testextextile.com, Blog>>Fabric Pilling: What to Know, Do and Expect, the Complete Guide, Nov. 2, 2017.
www.mcpolymers.com, Mallard Creek Polymers, Rovene® 6016 Acrylic Emulsion, Technical Data Sheet.

(Continued)

*Primary Examiner* — James M Mellott
(74) *Attorney, Agent, or Firm* — Hoffmann & Baron, LLP; Edward K. Welch, II

(57) ABSTRACT

Various aqueous anti-pilling fabric treatment compositions are described. The compositions include one or more aqueous polyurethane dispersions or one or more acrylic polymers or both and a silicone. The compositions can be used treat fabrics, textiles and articles of manufacture made therefrom to impart anti-pilling properties to the same.

12 Claims, 8 Drawing Sheets

(56) References Cited

OTHER PUBLICATIONS www.Celanese-Emulsions, Celanese, Nacrylic® 4460 Technical Data Sheet.
www.unionspecialtiesinc.com, Additive S-7A, Technical Data Sheet Nov. 2018.
www.unionspecialtiesinc.com, Additive GF, Technical Data Sheet Apr. 2014.
www.unionspecialtiesinc.com, Unithane IC-910 NF, Technical Data Sheet Nov. 2016.
www.unionspecialtiesinc.com, Unithane IC-850 NF, Technical Data Sheet Mar. 2018.

* cited by examiner

WATER-BASED ANTI-PILLING FABRIC TREATMENT COMPOSITIONS

RELATED APPLICATION

The present application claims the benefit of U.S. Provisional Patent Application No. 63/157,253 entitled Water-Based Anti-Pilling Fabric Treatment Compositions filed on Mar. 3, 2021, the contents of which are incorporated herein in total by reference.

FIELD OF THE INVENTION

The present teaching relates to fabric treatment compositions comprising select polyurethane dispersions and/or acrylic emulsions and select silicones for the antipilling treatment of textiles, fabrics and articles of manufacture made therefrom. In particular it relates to aqueous fabric treatment compositions for use in the OEM finishing of textiles and fabrics as well as in the post manufacture treatment of articles of manufacture of textiles and fabrics and, finally, the consumer application of the fabric treatment compositions to articles of manufacture as a spray or through laundering.

BACKGROUND

In the context of fabrics and textiles, pilling refers to the loose strands and agglomerations of fibers and/or fibrils on the surface of a textile or fabric. Most commonly they appear as balls or ball-like structures, particularly in their more pronounced state. Pilling results from normal wear and tear on the fabric or textile and is a surface defect that is readily visible and damages the aesthetic function, particularly the look and feel, of the fabric or textile, most especially the article of manufacture made therefrom. Pilling most typically occurs from abrasion occurring during normal use and cleaning. Certain textiles and fabrics are more prone to pilling than others, especially with respect to the material comprising the fibers or yarns, and, in the case of textiles, the weave.

Pilling can be removed mechanically to return the aesthetic appeal to the fabric or textile or article made therefrom; however, excessive pilling and repeated development and removal of pilling and pills leads to a loss in the integrity and strength of the fabric or textile and, eventually, the wearing through of the fabric or textile. Additionally, attempts have been made to improve the pilling resistance of fabrics and textiles; however, such efforts have been unsuccessful, from a commercial standpoint, or with limited success and/or require application processes that limit their use and may affect other properties of the fabric or textiles.

Accordingly, there is a need for improved anti-pilling treatments, especially treatments that may be used in industrial applications to bulk fabrics and textiles, while also capable of use in OEM manufacturing settings to articles of manufacture made with fabrics and textiles. Furthermore, there is a need for a consumer treatment that the consumer can apply to add anti-pilling properties or replenish such properties where anti-pilling characteristics are lost through laundering.

SUMMARY

It has now been found that an aqueous fabric treatment composition comprising (I) a polymer/polymer forming component and (II) a silicone component wherein the polymer/polymer forming component (I) comprises either (a) at least one cross-linkable aliphatic polyurethane dispersion, (b) at least one self-crosslinking acrylic or acrylic copolymer emulsion or (c) a combination of both (a) and (b) and the silicone component comprises a silicone dispersion or a silicone that is made readily dispersible, and wherein the weight ratio of the solid/solid forming components of the composition (I:II) is from 1:0.3 to 1:0.01, preferably 1:0.25 to 1:0.02, more preferably from 1:0.2 to 1:0.05, most preferably 1:0.15 to 1:0.08 provides excellent anti-pilling characteristics when applied to fabrics and textiles. In those instances where the solids content of the silicone component is low as compared to solids content of the other component(s), e.g., when there is a difference in solids content of 5% or greater, preferably 10% or greater, the foregoing ranges allow for lower levels with respect to the silicone component, e.g., 1:0.2 to 1:0.005, preferably 1:0.15 to 1:0.01, more preferably from 1:0.1 to 1:0.02, most preferably 1:0.1 to 1:0.03. Furthermore, again depending upon the percent solids contents of the dispersions and/or emulsion components, additional water may be added to the compositions so as to achieve a total solids/solids forming content of from 70 percent to 1 percent, preferably from 50 percent to 10 percent.

The compositions of the present teaching do not require extensive processing and curing requirements whereby they may be applied by fabric and textile manufacturers and processors to the bulk fabric or by OEM manufactures to articles of manufacture of fabrics and textiles or by consumers, particularly in association with their home laundering.

The present teaching also pertains to a method of improving the resistance of fabrics and textiles to pilling said method comprising applying to the fabric or textile an aqueous composition comprising (I) a polymer/polymer forming component and (II) a silicone component wherein the polymer/polymer forming component (I) comprises either (a) at least one cross-linkable polyurethane dispersion, preferably aliphatic polyurethane dispersion, (b) at least one self-crosslinking acrylic or acrylic copolymer emulsion or (c) a combination of both (a) and (b) and the silicone component comprises a silicone dispersion, and wherein the weight ratio of the solid/solid forming components of the composition (I:II) is from 1:0.3 to 1:0.01, preferably 1:0.25 to 1:0.02, more preferably from 1:0.2 to 1:0.05, most preferably 1:0.15 to 1:0.08 wherein the rate of application is from about 0.1 percent to about 2 percent, preferably from about 0.2 percent to about 1.2 percent based on the weight of solids and solids forming components to the weight of the fabric or textile to be treated. Again, as noted above, in those instances where the solids content of the silicone component is low as compared to solids content of the other component(s), e.g., when there is a difference in solids content of 5% or greater, preferably 10% or greater, the foregoing ranges allow for lower levels with respect to the silicone component, e.g., from 1:0.2 to 1:0.005, preferably 1:0.15 to 1:0.01, more preferably from 1:0.1 to 1:0.02, most preferably 1:0.1 to 1:0.03.

BRIEF DESCRIPTION OF THE DRAWINGS

The accompanying drawings which form a part of the specification are to be read in conjunction therewith.

DETAILED DESCRIPTION OF THE EMBODIMENTS

Figure 1:
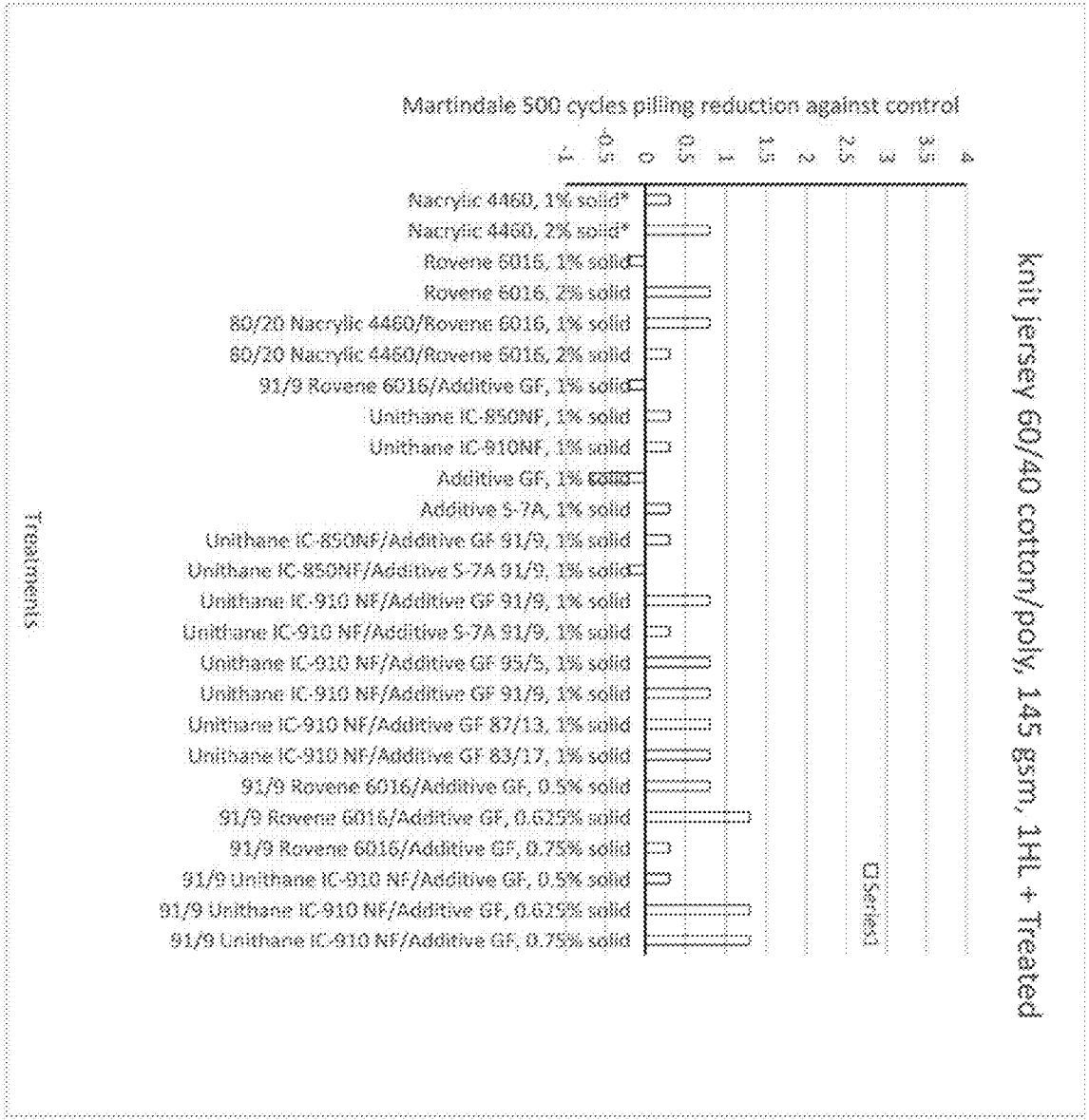
FIG. 1 is a bar chart presenting the anti-pilling performance of the tested materials of Example 1 after treatment.

The present subject matter provides various compositions particularly adapted for application to fabrics and textiles as well as articles of manufacture made therefrom to establish and/or improve resistance to pilling. In particular embodiments, the compositions can be applied as a surface coat or, preferably, particularly with respect to the treatment of bulk and cut fabric and textiles as well as articles of manufacture that accommodate it, by dipping, soaking, or flooding the fabric or textile with the composition. The compositions may be used with fabrics and textiles of natural fibers, synthetic fibers or a blend of both natural and synthetic fiber, e.g., cotton/polyester blends.

The compositions of the present subject matter generally comprise an aqueous blend or combination of (I) a polymer/polymer forming component and (II) a silicone component wherein the polymer/polymer forming component (I) comprises either (a) at least one cross-linkable polyurethane dispersion, preferably an aliphatic polyurethane dispersion, (b) at least one self-crosslinking acrylic or acrylic copolymer emulsion or (c) a combination of both (a) and (b) and the silicone component comprises a silicone dispersion, and wherein the weight ratio of the solid/solid forming components of the composition (I:II) is from 1:0.3 to 1:0.01, preferably 1:0.25 to 1:0.02, more preferably from 1:0.2 to 1:0.05, most preferably 1:0.15 to 1:0.08 provides excellent anti-pilling characteristics when applied to fabrics and textiles. In those instances where the solids content of the silicone component is low as compared to solids content of the other component(s), e.g., when there is a difference in solids content of 10% or greater, preferably 15% or greater, i.e., I has a solids content of 47% and II has a solids content of 20%, the foregoing ranges allow for lower levels with respect to the silicone component, e.g., 1:0.2 to 1:0.005, preferably 1:0.15 to 1:0.01, more preferably from 1:0.1 to 1:0.02, most preferably 1:0.1 to 1:0.03. Furthermore, again depending upon the percent solids contents of the dispersions and/or emulsion components, additional water may be added to the compositions so as to achieve a total solids/solids forming content of from 70 percent to 1 percent, preferably from 50 percent to 10 percent.

Aqueous polyurethane dispersions (PUDs) are well known and are used in the textile industry to provide various properties to fabrics and textiles including chemical and stain resistance, water repellency, and durability. They generally comprise polyurethane prepolymers of isocyanates and polyols, including polyester polyols, as well as a dispersing agent and/or a cross-linker or chain extender. Although perhaps the most common PUDs are aromatic polyurethanes, the present teaching is specific to the use of aliphatic and cycloaliphatic polyurethane dispersions, including aliphatic and cycloaliphatic polyester polyurethan dispersions, known for use as fabric and textile treatments. Specifically, preferred polyurethane dispersions for use in the practice of the present teaching include those wherein the urethane prepolymer is formed of aliphatic diisocyanates, alone or together with a minor proportion, less than 20 mole %, preferably less than 10 mole %, based on the total isocyanate, of a mono isocyanate or polyisocyanate. Exemplary isocyantes include tetramethylene diisocyanate, hexamethylene diisocyanate, octamethylene diisocyanate, ethyl hexamethylene diisocyante, methylene-bis(4-cyclohexylisocyanate), isophorone diisocyanate, cyclohexane-1,4-diisocyanate, and dimer acid diisocyanate (DDI), and combinations of the foregoing.

Alternatively or in addition to the aforementioned polyurethane emulsions, the compositions of the present teaching comprise a self-crosslinking acrylic emulsion. Like the polyurethane dispersions, these compositions are also well known and employed in the fabric and textile treatment market as an alternative to the polyurethane dispersions. Generally speaking, the backbone of the acrylic prepolymer typically contains a suitable level of acrylic and methacrylic monomers to impart hydrophilicity to the overall prepolymer. Suitable acrylic emulsions are those known for use in fabric and textile treatment and may be used alone or as a combination of such acrylic emulsions.

As noted, the present teaching also contemplates combinations of the aforementioned polyurethane dispersions and self-crosslinking acrylic emulsions. In one embodiment, the two aqueous solutions may simply be blended, generally, based on solids/solid forming contents of each component, at a ratio 1:10 to 10:1, preferably 1:5 to 8:1, more preferably 1:2 to 2:1 most preferably about 1:1. However, the specific ratio will also depend upon the solids content of each component as well as additional physical properties, beyond the anti-pilling effect of the present compositions, desired of the treatment composition. When the treatment composition is dried on the fabric or textile, the treatment consists of discrete domains of polyurethane and polyacrylate.

Alternatively, the polyurethane dispersion and acrylic emulsion may be combined and partially reacted to form urethane-acrylic composite particles. In the case of such composite particles, it is preferred that the weight ratio of solids/solid forming components of each component be from about 1:3 to 3:1, preferably 1:2 to 2:1, more preferably about 1:1.

The final critical active component of the compositions of the present teaching is the silicone, which is either present as an aqueous dispersion or is modified to make it readily dispersed/dispersible in water: most preferably and for ease of use, the silicone component is an aqueous silicone dispersion. In particular, while the silicone may be dispersed in the polyurethane dispersion and/or the acrylic emulsion, it is preferred that a separate silicone dispersion be made which is then combined with the other to complete the composition. Suitable silicones and silicone dispersions are also well known in the fabric and textile industry and are typically used as fabric softeners/fabric softener additives.

As noted, the weight ratio of the polymer/polymer forming component(s) to the silicone component (I:II) is from 1:0.3 to 1:0.01, preferably 1:0.25 to 1:0.02, more preferably from 1:0.2 to 1:0.05, most preferably 1:0.15 to 1:0.08 provides excellent anti-pilling characteristics when applied to fabrics and textiles. In those instances where the solids content of the silicone component is low as compared to solids content of the other component(s) the foregoing ranges allow for lower ratios with respect to the silicone component, e.g., 1:0.2 to 1:0.005, preferably 1:0.15 to 1:0.01, more preferably from 1:0.1 to 1:0.02, most preferably 1:0.1 to 1:0.03.

Furthermore, depending upon the solids/solid forming content of the components, additional water may be added to the compositions or to the mixture as the composition is being formed in order to provide a suitable viscosity for application to the fabric or textile depending upon the method of application and the rate of application. Generally speaking, the solids/solids forming concentration of the fabric treatment composition will be from 70 to 1, preferably from 50 to 10, based on the total composition. Again, the specific concentration will depend, in part, on the solids content of the materials themselves as well as how it is to be applied, when it is to be applied and who is doing the application. For example, in the case of bulk fabric or textile treatment of bulk treatment of articles of manufacture, such as clothing, drapes, bedding, and the like, the concentration may be from 70 to 1. On the other hand, for a post manufacture treatment to be applied to an article of manufacture that is not capable of bulk treatment, e.g., an upholstered chair, couch or the like, a higher solids content may be desired, for instance, the concentration may be from 70 to 10, preferably 50 to 20. In any event, it is desired to achieve a rate of application of from about 0.05 to about 4 percent, preferably 0.1 percent to about 2 percent, more preferably from about 0.2 percent to about 1.2 percent based on the weight of solids and solids forming components to the weight of the fabric or textile to be treated. Higher amount are possible, but not cost effective.

The compositions of the present teaching do not require extensive processing to manufacture and are prepared by simply blending the ingredients to form the desired end-product. Similarly, the compositions of the present teaching do not require extensive processing and curing requirements. The compositions of the present teaching may be applied by any known and appropriate method for the fabric or textile or article of manufacture to be treated. For example, fabric and textile manufacturers and processors may apply the compositions to the bulk fabric, OEM manufacturers may apply the composition to the fabrics prior to or post cutting or to the articles of manufacture made therefrom. Additionally, consumers and commercial launderers can apply the compositions in conjunction with their laundering efforts. Application itself may be by an method appropriate for the specific application/use contemplated. For example, bulk fabric and textile as well as articles of manufacture made therefrom such as clothing, drapes, bedding and the like, may be treated by pad, exhaustion, coating, immersion, soaking, dipping, spraying, drenching (i.e., pass through a waterfall of the composition), and the like. Otherwise, particularly with respect to articles of manufacture that incorporate other components or materials that do not accommodate complete treatment, e.g., upholstered chairs, couches, pillows and the like, the article may be sprayed or misted. Additionally, the articles of manufacture, particularly clothing, bedding and the like can be treated during laundering by the addition of the composition to the washing machine like a fabric softener.

Having described the aqueous compositions and their use, attention is now drawn to the following examples exemplifying various compositions and comparative compositions and their anti-piling efficacy on a plurality of fabrics. In the examples, the following ingredients/materials were employed:

| Material | Type | Manufacturer |
|---|---|---|
| Additive GF | Aqueous high MW silicone dispersion (16-19% solids) | Union Specialties, Inc., Newburyport, MA |
| Additive S-7A | Modified water dispersible high solids silicone (58-62% solids) | Union Specialties, Inc., Newburyport, MA |
| Nacrylic ® 4460 | Self-crosslinking acrylic polymer emulsion (~47% solids) | Celanese Dallas, TX |
| Rovene ® 6016 | Self-crosslinking acrylic copolymer emulsion (48-50% solids) | Mallard Creek Polymers, Inc. Charlotte, NC |
| Unithane IC-850NF | Aqueous hexamethylene diisocyante based polyurethane dispersion (34-36% solids) | Union Specialties, Inc., Newburyport, MA |
| Unithane IC-910NF | Aqueous isophorone diisocyanate based polyurethane dispersion (31-33% solids) | Union Specialties, Inc., Newburyport, MA |

For each evaluation, two swatches of the various fabrics measuring 12 inches by 15 inches were washed (1HL) and then treated with the indicated composition and comparative compositions. Treatment was performed by pad application. Following the padding, the fabrics were cured at 160° C. for 3 minutes. Half of the treated swatches were evaluated for pilling resistance pursuant to ASTM D4970/D4970M using a Martindale Tester. The other half were subjected to 4 additional, sequential launderings (4HL), dried and then evaluated for pilling resistance. The compositions and results for each fabric and composition are shown in the tables and charts below. In the tables, the "% solid" following each formulation refers to the weight of the solids/solid forming components to the weight of the fabric on the treated fabrics. The ratings are as follows: 1—very severe pilling, 2—severe pilling, 3—moderate pilling, 4—slight pilling and 5—no pilling.

Example 1—Fabric 1, Knit Jersey 60/40 Cotton/Poly, 145 Gsm

Figure 2:
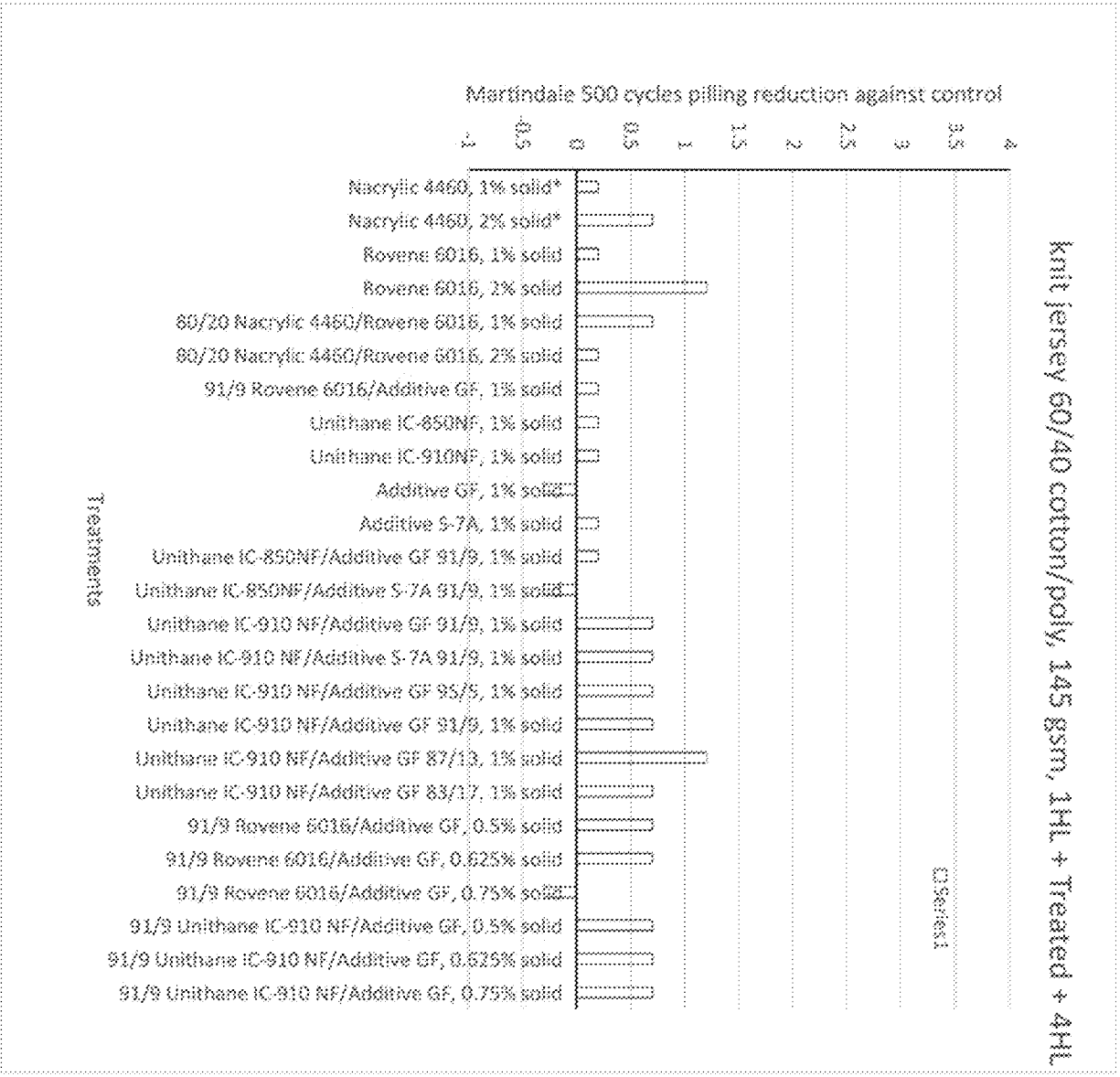
FIG. 2 is a bar chart presenting the anti-pilling performance of the tested materials of Example 1 after four washings following treatment.

Table 1 shows the composition of various fabric treatments according to the present teaching as well as comparative treatments and the performance thereof in pill resistance thereof on knit jersey 60/40 cotton polyester blend fabric. FIGS. 1 and 2 show the improvement of antipilling performance over that of untreated control fabric (water only) as well as between treatments within and outside of the scope of the present teaching in graphic form.

TABLE 1

| | 1HL Treated | 1HL + Treated + 4 HL |
|---|---|---|
| Nacrylic 4460, 1% solid* | 2 | 1.5 |
| Nacrylic 4460, 2% solid* | 2.5 | 2 |
| Rovene 6016, 1% solid | 1.5 | 1.5 |
| Rovene 6016, 2% solid | 2.5 | 2.5 |
| 80/20 Nacrylic 4460/Rovene 6016, 1% solid | 2.5 | 2 |
| 80/20 Nacrylic 4460/Rovene 6016, 2% solid | 2 | 1.5 |
| 91/9 Rovene 6016/Additive GF, 1% solid | 1.5 | 1.5 |
| Unithane IC-850NF, 1% solld | 2 | 1.5 |

TABLE 1-continued

| | 1HL Treated | 1HL + Treated + 4 HL |
|---|---|---|
| Unithane IC-910NF, 1% solid | 2 | 1.5 |
| Additive GF, 1% solid | 1 | 1 |
| Additive S-7A, 1% solid | 2 | 1.5 |
| Unithane IC-850NF/Additive GF 91/9, 1% solid | 2 | 1.5 |
| Unithane IC-850NF/Additive S-7A 91/9, 1% solid | 1.5 | 1 |
| Unithane IC-910 NF/Additive GF 91/9, 1% solid | 2.5 | 2 |
| Unithane IC-910 NF/Additive S-7A 91/9, 1% solid | 2 | 2 |
| Unithane IC-910 NF/Additive GF 95/5, 1% solid | 2.5 | 2 |
| Unithane IC-910 NF/Additive GF 91/9, 1% solid | 2.5 | 2 |
| Unithane IC-910 NF/Additive GF 87/13, 1% solid | 2.5 | 2.5 |
| Unithane IC-910 NF/Additive GF 83/17, 1% solid | 2.5 | 2 |
| 91/9 Rovene 6016/Additive GF, 0.5% solid | 2.5 | 2 |
| 91/9 Rovene 6016/Additive GF, 0.625% solid | 3 | 2 |
| 91/9 Rovene 6016/Additive GF, 0.75% solid | 2 | 1 |
| 91/9 Unithane IC-910 NF/Additive GF, 0.5% solid | 2 | 2 |
| 91/9 Unithane IC-910 NF/Additive GF, 0.625% solid | 3 | 2 |
| 91/9 Unithane IC-910 NF/Additive GF, 0.75% solid | 3 | 2 |
| Water only | 1.7 | 1.3 |

*The formulation of Nacrylic 4460 was applied onto fabric in such amount that the dry solid of the formulation was 1 weight percent based on weight of fabric.

Example 2—Fabric 2, Knit Jersey 50/50 Cotton/Poly, 180 GSM

Figure 3:
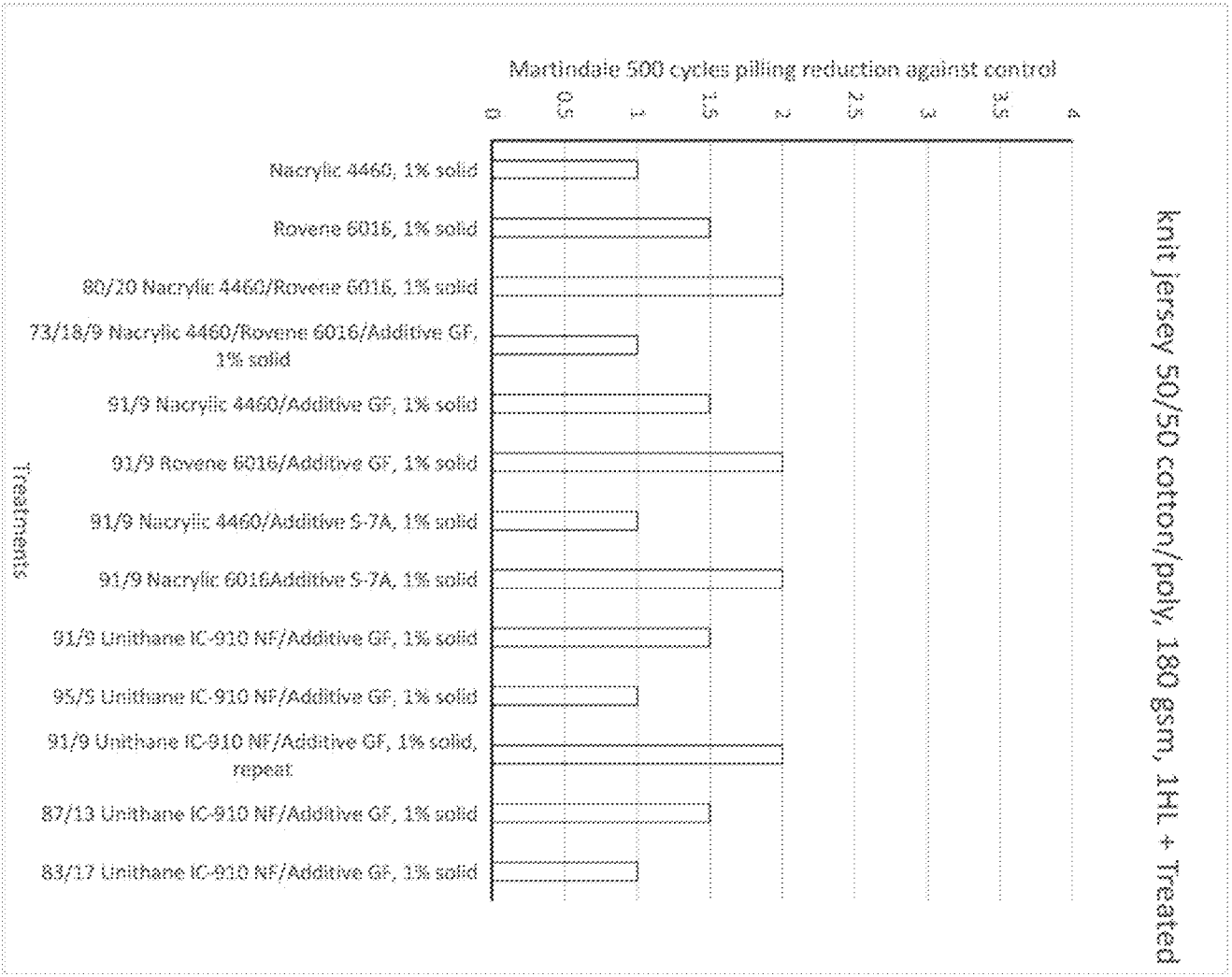
FIG. 3 is a bar chart presenting the anti-pilling performance of the tested materials of Example 2 after treatment.
Figure 4:
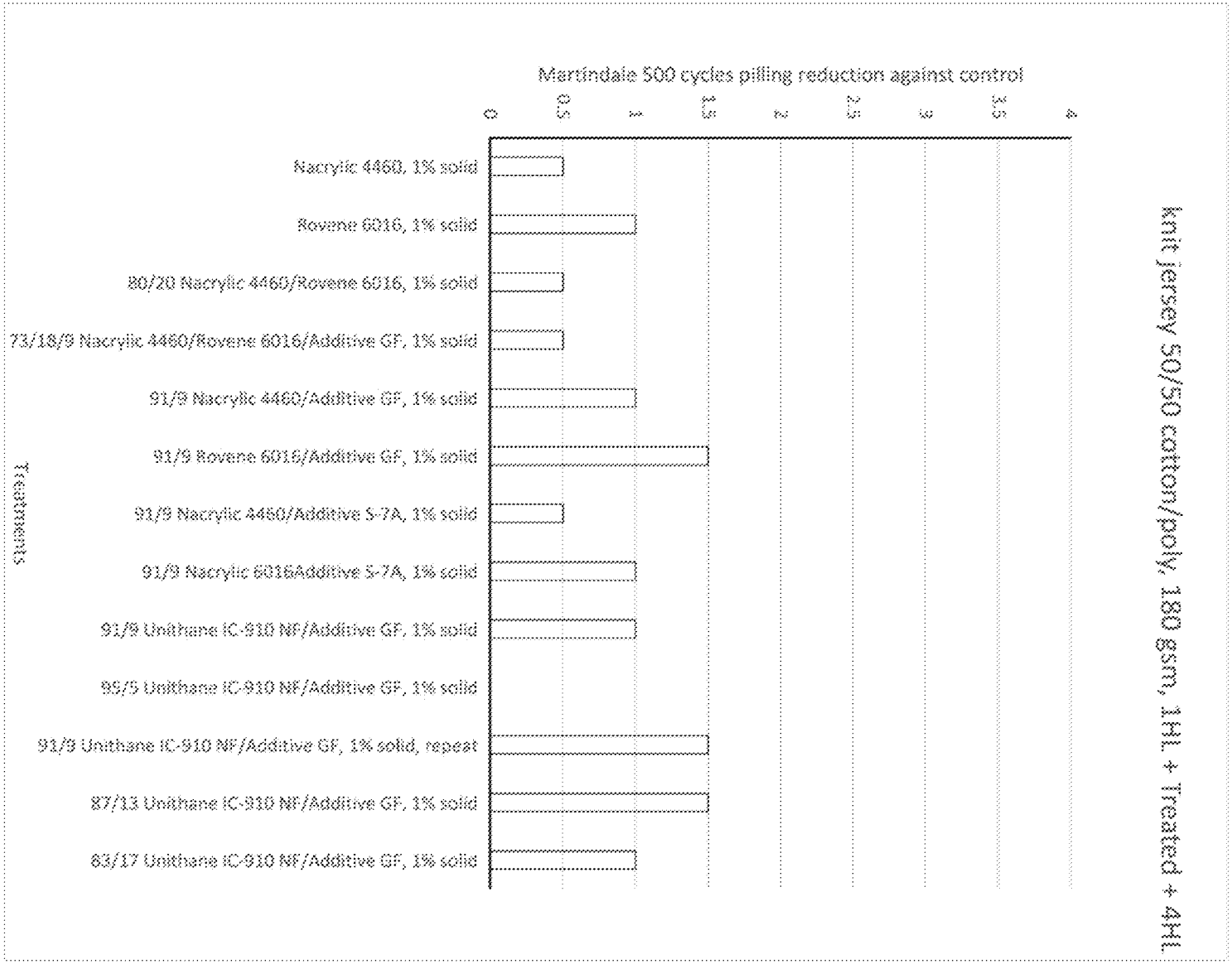
FIG. 4 is a bar chart presenting the anti-pilling performance of the tested materials of Example 2 after four washings following treatment.

Table 2 shows the composition of various fabric treatments according to the present teaching as well as comparative treatments and the performance thereof in pill resistance thereof on a knit jersey 50/50 cotton/poly fabric. FIGS. 3 and 4 show the improvement of antipilling performance over that of untreated control fabric (water only) as well as between treatments within and outside of the scope of the present teaching in graphic form.

TABLE 2

| | 1HL + Treated | 1HL + Treated + 4 HL |
|---|---|---|
| Nacrylic 4460, 1% solid | 3 | 2.5 |
| Rovene 6016, 1% solid | 3.5 | 3 |
| 80/20 Nacrylic 4460/Rovene 6016, 1% solid | 4 | 2.5 |
| 73/18/9 Nacrylic 4460/Rovene 6016/Additive GF, 1% solid | 3 | 2.5 |
| 91/9 Nacrylic 4460/Additive GF, 1% solld | 3.5 | 3 |
| 91/9 Rovene 6016/Additive GF, 1% solid | 4 | 3.5 |
| 91/9 Nacrylic 4460/Additive S-7A, 1% solid | 3 | 2.5 |
| 91/9 Nacrylic 6016Additive S-7A, 1% solid | 4 | 3 |
| 91/9 Unithane IC-910 NF/Additive GF, 1% solid | 3.5 | 3 |
| 95/5 Unithane IC-910 NF/Additive GF, 1% solid | 3 | 2 |
| 91/9 Unithane IC-910 NF/Additive GF, 1% solid, repeat | 4 | 3.5 |
| 87/13 Unithane IC-910 NF/Additive GF, 1% solid | 3.5 | 3.5 |
| 83/17 Unithane IC-910 NF/Additive GF, 1% solid | 3 | 3 |
| Water only | 2 | 2 |

Example 3—Fabric 3, Woven 78/22 Poly/Acrylic, 350 Gsm

Figure 5:
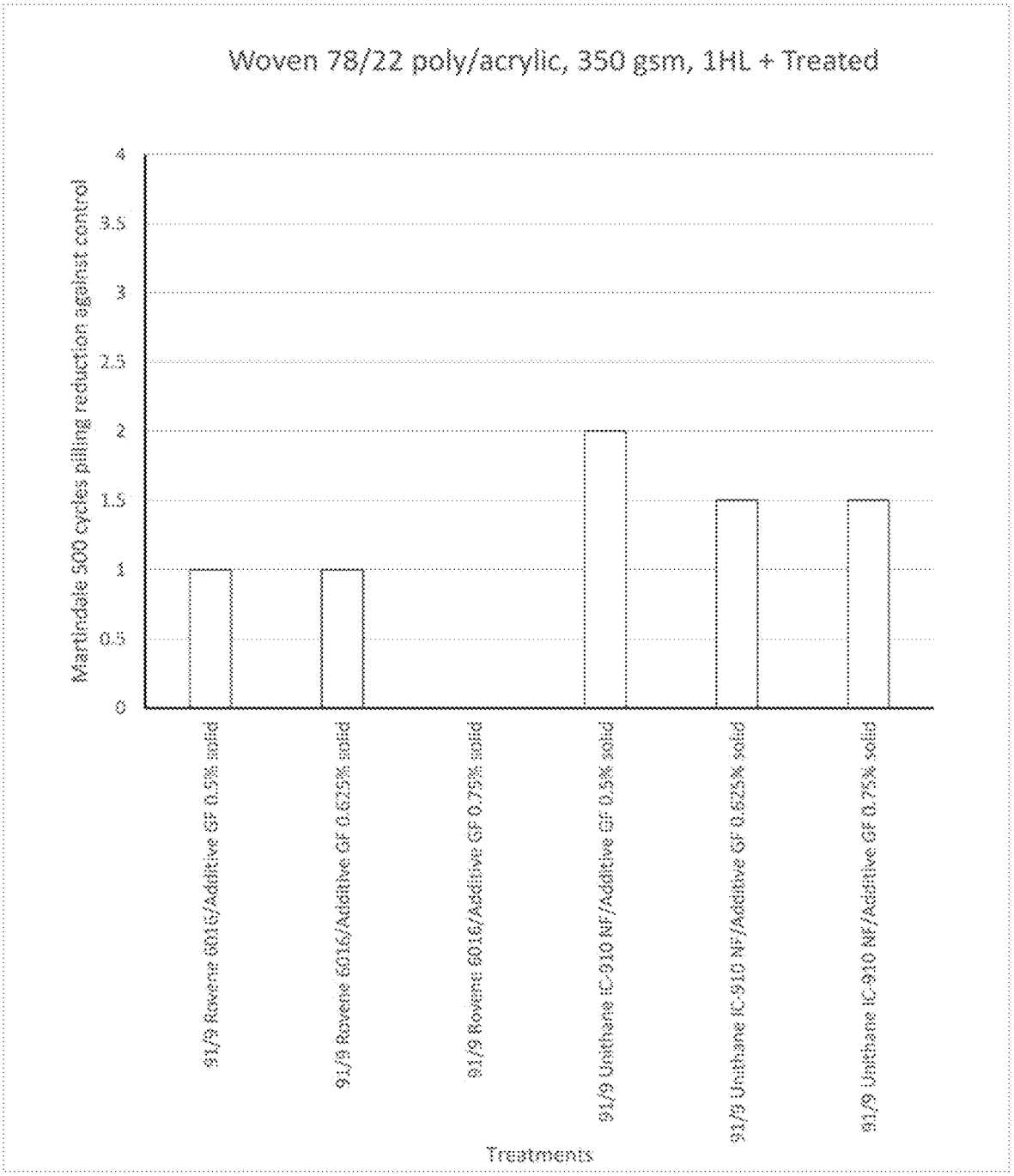
FIG. 5 is a bar chart presenting the anti-pilling performance of the tested materials of Example 3 after treatment.
Figure 6:
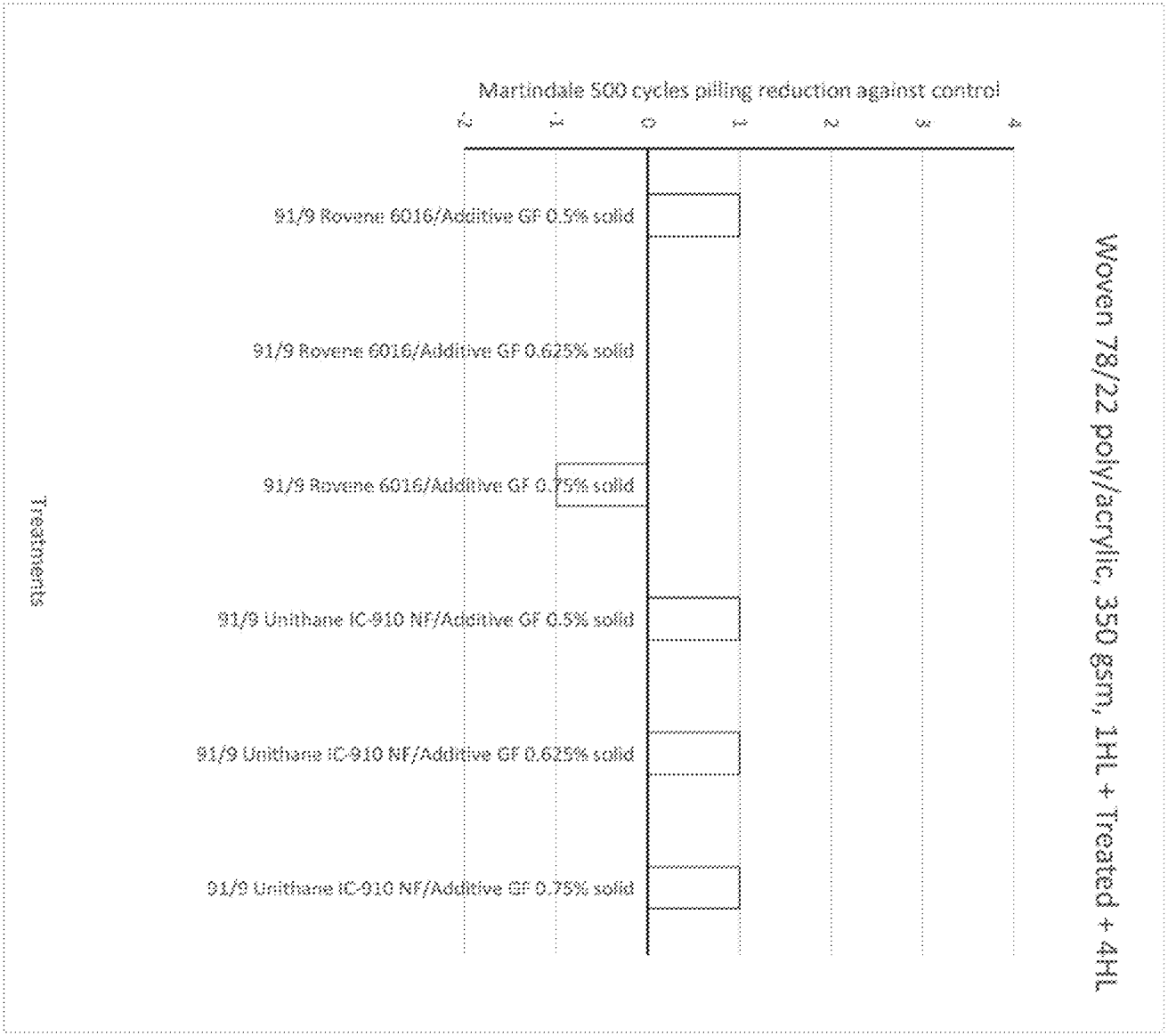
FIG. 6 is a bar chart presenting the anti-pilling performance of the tested materials of Example 3 after four washings following treatment.

Table 3 shows the composition of various fabric treatments according to the present teaching as well as comparative treatments and the performance thereof in pill resistance thereof on a woven 78/22 poly/acrylic fabric. FIGS. 5 and 6 show the improvement of antipilling performance over that of untreated control fabric (water only) as well as between treatments within and outside of the scope of the present teaching in graphic form.

TABLE 3

| | 1HL + Treated | 1HL + Treated + 4 HL |
|---|---|---|
| 91/9 Rovene 6016/Additive GF 0.5% solid | 4 | 4 |
| 91/9 Rovene 6016/Additive GF 0.625% solid | 4 | 3 |
| 91/9 Rovene 6016/Additive GF 0.75% solid | 3 | 2 |
| 91/9 Unithane IC-910 NF/Additive GF 0.5% solid | 5 | 4 |
| 91/9 Unithane IC-910 NF/Additive GF 0.625% solid | 4.5 | 4 |
| 91/9 Unithane IC-910 NF/Additive GF 0,75% solid | 4.5 | 4 |
| Water | 3 | 3 |

Example 4—Fabric 4, Knit Hacci 100% Poly, 210 Gsm

Figure 7:
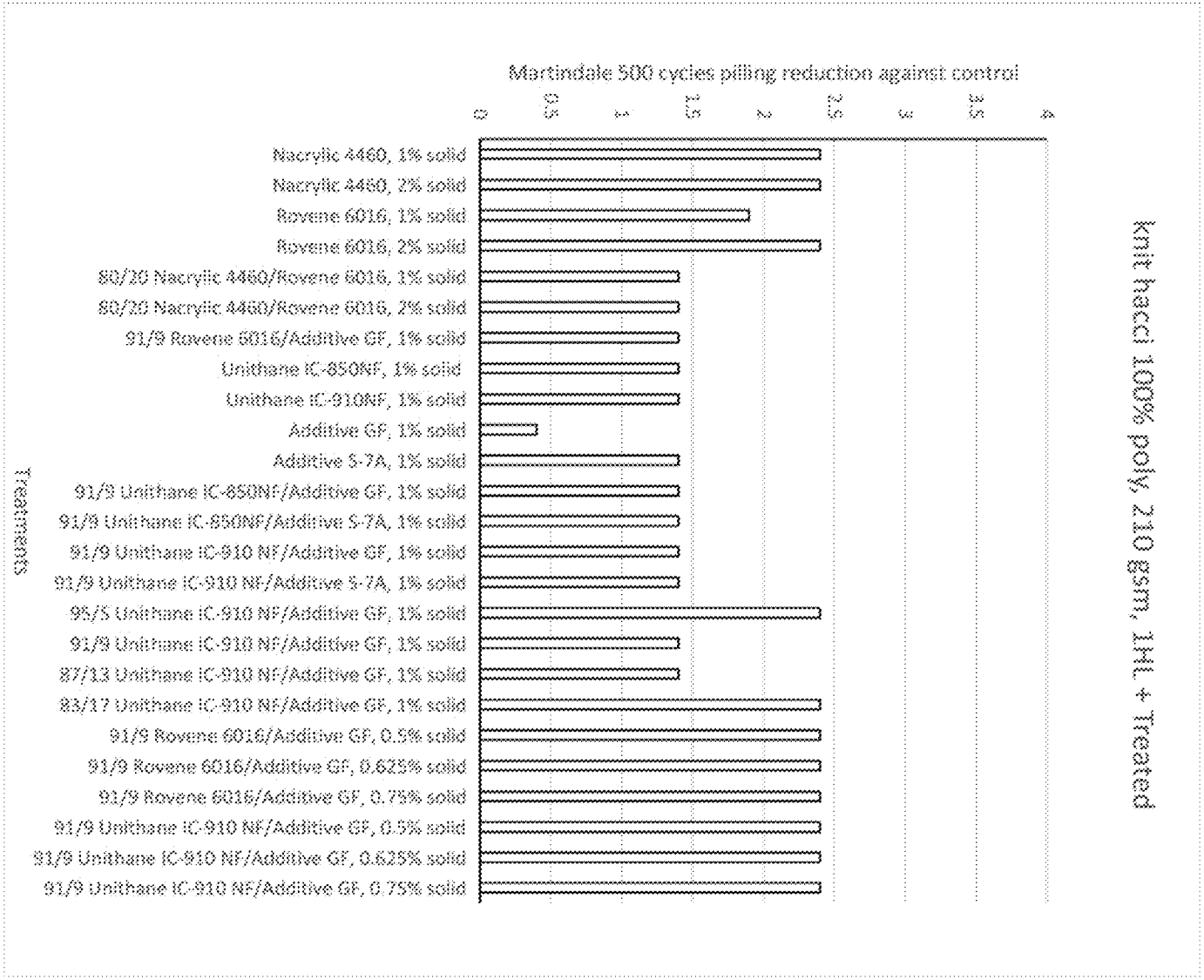
FIG. 7 is a bar chart presenting the anti-pilling performance of the tested materials of Example 4 after treatment.
Figure 8:
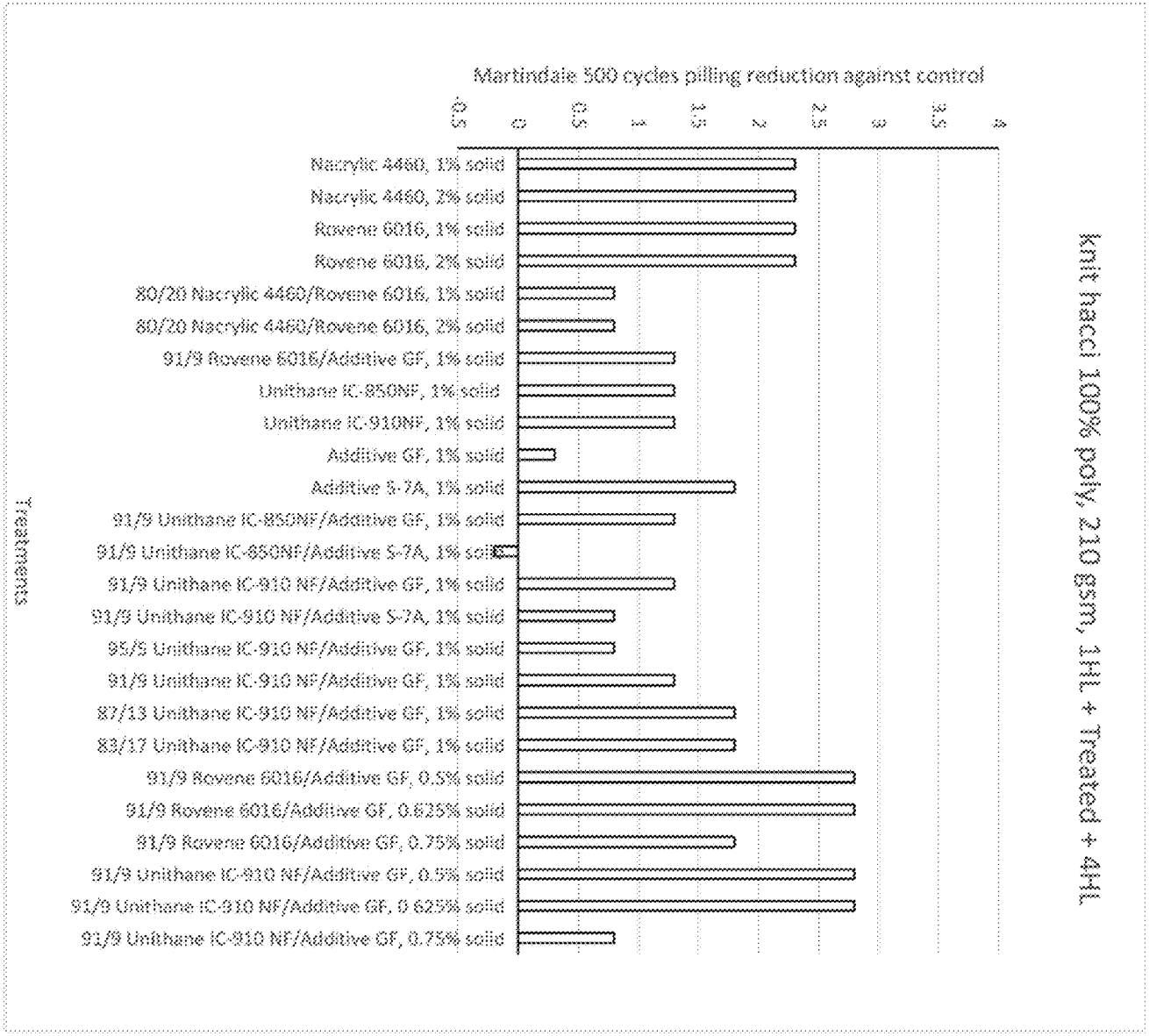
FIG. 8 is a bar chart presenting the anti-pilling performance of the tested materials of Example 4 after four washings following treatment.

Table 4 shows the composition of various fabric treatments according to the present teaching as well as comparative treatments and the performance thereof in pill resistance thereof on a knit Hacci 100% poly fabric. FIGS. 7 and 8 show the improvement of antipilling performance over that of untreated control fabric (water only) as well as between treatments within and outside of the scope of the present teaching in graphic form.

TABLE 4

| | 1HL + Treated | 1HL + Treated + 4 HL |
|---|---|---|
| Nacrylic 4460, 1% solid | 4 | 3.5 |
| Nacrylic 4460, 2% solid | 4 | 3.5 |
| Rovene 6016, 1% solid | 3.5 | 3.5 |
| Rovene 6016, 2% solid | 4 | 3.5 |
| 80/20 Nacrylic 4460/Rovene 6016, 1% solid | 3 | 2 |
| 80/20 Nacrylic 4460/Rovene 6016, 2% solid | 3 | 2 |
| 91/9 Rovene 6016/Additive GF, 1% solid | 3 | 2.5 |
| Unithane IC-850NF, 1% solid | 3 | 2.5 |
| Unithane IC-910NF, 1% solid | 3 | 2.5 |
| Additive GF, 1% solid | 2 | 1.5 |
| Additive S-7A, 1% solid | 3 | 3 |
| 91/9 Unithane IC-850NF/Additive GF, 1% solid | 3 | 2.5 |
| 91/9 Unithane IC-850NF/Additive S-7A, 1% solid | 3 | 1 |
| 91/9 Unithane IC-910 NF/Additive GF, 1% solid | 3 | 2.5 |
| 91/9 Unithane IC-910 NF/Additive S-7A, 1% solid | 3 | 2 |
| 95/5 Unithane IC-910 NF/Additive GF, 1% solid | 4 | 2 |
| 91/9 Unithane IC-910 NF/Additive GF, 1% solid | 3 | 2.5 |
| 87/13 Unithane IC-910 NF/Additive GF, 1% solid | 3 | 3 |
| 83/17 Unithane IC-910 NF/Additive GF, 1% solid | 4 | 3 |
| 91/9 Rovene 6016/Additive GF, 0.5% solid | 4 | 4 |
| 91/9 Ravene 6016/Additive GF, 0.625% solid | 4 | 4 |
| 91/9 Rovene 6016/Additive GF, 0.75% solid | 4 | 3 |
| 91/9 Unithane IC-910 NF/Additive GF, 0.5% solid | 4 | 4 |
| 91/9 Unithane IC-910 NF/Additive GF, 0.625% solid | 4 | 4 |
| 91/9 Unithane IC-910 NF/Additive GF, 0.75% solid | 4 | 2 |
| Water only | 1.6 | 1.2 |

Without further elaboration, it is believed that one skilled in the art, using the preceding description, can utilize the teachings set forth herein to its fullest extent and, without departing from the spirit and scope thereof, can make various changes and modifications of the invention to adapt it to various usages and conditions. The preceding preferred specific embodiments are, therefore, to be construed as merely illustrative, and not limitative of the remainder of the disclosure in any way whatsoever.

We claim:

1. A method of improving the resistance of fabrics and textiles to pilling said method comprising 1) applying to the fabric or textile an anti-pilling effective amount of a curable/cross-linkable aqueous composition comprising (I) a polymer/polymer forming component and (II) a silicone component, wherein the polymer/polymer forming component (I) comprises either (a) a polyurethane dispersion comprising at least one cross-linkable aliphatic and/or cycloaliphatic polyurethane and a cross-linker for effecting cross-linking of the polyurethane, (b) an acrylic emulsion comprising at least one self-crosslinking acrylic polymer or acrylic copolymer or (c) a combination of both (a) and (b) and the silicone component comprises a silicone dispersion, and the total solids/solids forming components content of the composition is from 70 to 1 wt % of the composition based on the total weight of the composition and wherein said anti-pilling effective amount is from about 0.05 percent to about 4 percent based on the weight of solids and solids forming components to the weight of the fabric or textile to be treated and 2) subjecting the treated fabric to conditions to cure and cross-link the curable/cross-linkable composition whereby the treated fabric retains improved antipilling properties, as compared to untreated fabric, even after four washes.

2. The method of claim 1 wherein the rate of application is from about 0.1 to about 2 percent.

3. The method of claim 1 wherein the weight ratio of the solid/solid forming components of the composition (I:II) is from 1:0.3 to 1:0.01.

4. The method of claim 1 wherein the weight ratio of the solid/solid forming components of the composition (I:II) is from 1:0.2 to 1:0.05.

5. The method of claim 1 wherein the weight ratio of the solid/solid forming components of the composition (I:II) is from 1:0.2 to 1:0.005.

6. The method of claim 1 wherein the weight ratio of the solid/solid forming components of the composition (I:II) is from 1:0.15 to 1:0.01.

7. The method of claim 1 wherein the weight ratio of the solid/solid forming components of the composition (I:II) is from 1:0.1 to 1:0.03.

8. The method of claim 1 wherein the polymer/polymer forming component (I) is a polyurethane dispersion.

9. The method of claim 1 wherein the polymer/polymer forming component (I) is a self-crosslinking acrylic polymer or acrylic copolymer emulsion.

10. The method of claim 1 wherein the polymer/polymer forming component (I) is a combination of (a) an aliphatic polyurethane dispersion and (b) a self-crosslinking acrylic polymer or acrylic copolymer emulsion and the weight ratio of the solid(s)/solid forming components of each is from 10:1 to 1:10.

11. The method of claim 1 wherein the cure/crosslinking is accomplished by subjecting the treated fabric to a temperature and for a time period sufficient to effect cure/crosslinking of the cross-linkable aliphatic and/or cycloaliphatic polyurethane and/or the self-crosslinking acrylic polymer or acrylic copolymer.

12. The method of claim 1 wherein polyurethane is a urethane prepolymer formed of aliphatic diisocyanates, alone or together with less than 20 mole %, based on the total isocyanate, of a mono isocyanate or polyisocyanate.

* * * * *